United States Patent [19]

Heier

[11] 4,254,869

[45] Mar. 10, 1981

[54] MERCHANDISING PACKAGE FOR CONTAINERS AND METHOD OF MAKING

[75] Inventor: Robert J. Heier, Whitehouse, Ohio

[73] Assignee: Owens-Illinois, Inc., Toledo, Ohio

[21] Appl. No.: 57,139

[22] Filed: Jul. 12, 1979

[51] Int. Cl.[3] ..... B65D 65/00; B65D 75/26

[52] U.S. Cl. ..... 206/497; 206/45.33; 206/432; 229/DIG. 12; 428/910; B65D/85/62

[58] Field of Search ..... 206/497, 45.33, 432; 229/DIG. 12; 428/910, 315

[56] References Cited

U.S. PATENT DOCUMENTS

| | | | |
|---|---|---|---|
| 3,620,898 | 1/1971 | Harris | 428/910 |
| 3,933,244 | 1/1976 | Hughes | 206/497 |

*Primary Examiner*—William T. Dixson, Jr.

*Attorney, Agent, or Firm*—E. J. Holler; M. E. Click; D. H. Wilson

[57] ABSTRACT

This invention relates to a method of utilizing a shrink wrap film to shrink wrap a load or group of articles or packages having a surface portion formed of the same material as the shrink wrap film. The load or group is assembled and wrapped with the outer ply of each article or package formed of the shrink wrap film being coated with a release coating which will withstand the heat shrinking and will not fuse to any part of the load or group when subjected to film-shrinking heat when the group is overwrapped with similar film. The wrapped load is thereby heated to shrink the film or laminate about the load, and may thereafter be easily removed.

13 Claims, 3 Drawing Figures

MERCHANDISING PACKAGE FOR CONTAINERS AND METHOD OF MAKING

BACKGROUND OF THE INVENTION

There is a growing practice to package many articles in plastic film enclosures rather than in paperboard cartons or the like. For example, many canned and bottled food and beverage products are now being packaged by placing them on simple linerboard or plastic trays and then passing them through conventional heat shrink apparatus in which they are wrapped in a shrinkable film material, usually polyethylene, which is then heat shrunk in place. This package technique is used in cases in which it has been conventional practice in the past to use corrugated cartons. These individual packages, which may consist of twelve or twenty-four cans or bottles of a product, are then loaded on pallets for shipment.

Because they slide relatively easily with respect to one another, they must be anchored to the pallet by suitable means. It is common to use shrink wrap palletizing techniques, wherein the pallet and load are enclosed at least in part by a sheet or preformed sleeve of heat-shrinkable film and then passed through a shrink tunnel where heat is applied and the film tightly shrunk about the load. A most commonly used heat shrink material for this purpose is polyethylene film; however, when such film is shrunk on loads of individual packages where the packages themselves are wrapped in polyethylene film, the shrinking heat applied in the tunnel causes the outer polyethylene sheet or sleeve to fuse to the individual packages on the pallet, thus making it difficult if not impossible to remove the individual packages intact from the pallet when they reach their destination.

The problem is similar in smaller six and eight-pack packages of containers which are wrapped in shrink wrap film or film and foam laminates. It is becoming common practice to wrap an assembled group of bottles in a heat-shrinkable preformed sleeve, and then wrapping a number of such packages into a larger integral package or unit.

SUMMARY OF THE INVENTION

A primary object of the present invention is to provide a packaging system, including method and package, which permits utilization of relatively-inexpensive foam polyethylene or foam polystyrene as the primary shrink wrap material and which obviates the aforementioned disadvantages of known techniques.

A related further object of this invention resides in the provision of an improved shrink wrap material which will not fuse to similar materials in the heat-shrinking process and which exhibits equal toughness and strength compared with commonly-used polyethylene film and film-foam laminates.

A still further object of the present invention is to provide an improved heat-shrinkable material which has an extremely thin overgloss of organic material which prevents its fusion to similar or dissimilar film-like materials in the heat-shrinking process.

These and other objects of the present invention will become apparent from the following description and appended claims.

DETAILED DESCRIPTION OF THE PREFERRED EMBODIMENT

Figure 1:
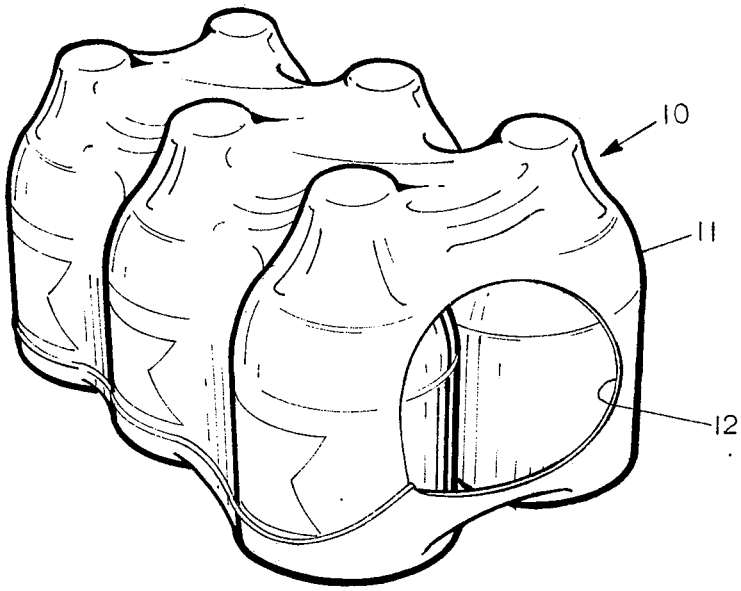
FIG. 1 is a perspective view of a single primary package of a six-bottle shrink pack wrapped in a single layer of heat-shrinkable, oriented thermoplastic sheet material.

A primary object of this invention is to provide an improved multicontainer merchandising package which is strong but yet is easily opened, opaque to light, and is capable of being preprinted with information or decoration prior to application and requires no external structure for handling purposes.

In attaining the objects of this invention, one feature resides in a multiple container merchandising package comprising a group of similarly-shaped containers held together in side-by-side fashion by a plastic overwrap which comprises an opaque, uniaxially oriented, laminated composite sleeve which is uniaxially oriented in the circumferential direction and comprises a closed cellular or foam thermoplastic polyolefin layer laminated to a non-cellular thermoplastic polyolefin film, said sleeve circumscribing the containers and snugly engaging the tops of the containers in shrink fit relation, the exterior surface of the sleeve being coated with a release coating.

An essential feature of the present invention is in the exterior coating of the heat-shrinkable polymeric sleeve to prevent its fusion to similar materials, the composite structure having a layer of a closed cellular or foam olefin polymer adhered to a layer of a non-cellular olefin polymer film wherein the cellular layer faces the inside of the sleeve in engagement with at least the tops of the containers and the film layer faces the outside of the sleeve and has a smooth glossy decorated surface.

The heat shrinkable composite or laminated material may be formed in accordance with known laminating techniques. The foam layer may be co-extruded with the film layer in either blow form or sheet form, it may be coated on the film layer with a sheet extruder, or separate foam and film plies may be laminated together using conventional adhesives or other known lamination techniques.

Generally, it is important that the foam ply be continuous and fully co-extensive with the film ply. The release coating is preferably placed over the exterior surface of the film ply after the pre-printed information and decoration is applied except in the area where the edges of several blanks are to be overlapped and joined, such as by a heat or fusion seal to form a tubular sleeve of prescribed circumference and length to loosely surround the group of assembled containers. Presence of any decorating inks or release coating in the overlapped area can interfere with seam formation upon fusing the thermoplastic laminated material. A preferred material is polyethylene film or a polyethylene film-foam laminate. In the case of the latter, it may have a thickness ranging from 3 to 20 mils, although about 5 to 15 mils is preferred for most applications.

The release coating preferably consists of a solvent-based polyamide-containing material which is compatible with the decorating inks. The material is used as an overgloss and protective coating for the inks to provide abrasion protection and scuff resistance.

After the decorating inks are applied over the plastic laminate in strip or roll form leaving gaps at spaced intervals to permit severing the roll into equi-sized uniform blanks, the overcoat is then applied normally by flexographic printing. The overcoat is not printed over the areas to be severed to permit uniform fusion sealing of the overlapped areas. The liquid material is held in a fountain in which is mounted a fountain roller. The fountain roller picks up the material and delivers it onto an anilox roller from which it is transferred to a plate cylinder. The sheet or web of thermoplastic material is backed by an impression cylinder as it is passed between the impression and plate cylinders. The latter carries the plates which determine the coating pattern to be applied to the sheet or web.

The coating material preferably consists of a polyamide-polyethylene wax containing material which is carried in an ethanol solvent. One product which has been successfully employed is Product No. AF-3186 8 GL-95 Poly-Gleen, an overprint varnish manufactured by CP&W Printing Ink Company of Jacksonville, Florida. This material is used having a viscosity of 23 to 25 seconds, Zahn Cup No. 2, and applied as a very thin layer over the decorated substrate. The material having an alcohol solvent is permitted to air-dry and serves to protect the underlying ink layers and substrate, as well as to prevent sticking to similar sleeves or layers, or to an overwrap when the multipacks are joined into a larger integral unit by shrinking an enclosing larger shrink wrap. The coating is normally deposited as a continuous imperforate film having a thickness of about 0.010 to 0.015 mils.

Figure 3:
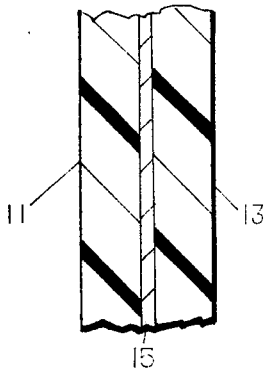
FIG. 3 is a fragmentary sectional view of the second layer of FIG. 2 having an interfacing continuous release coating thereon.
Figure 2:
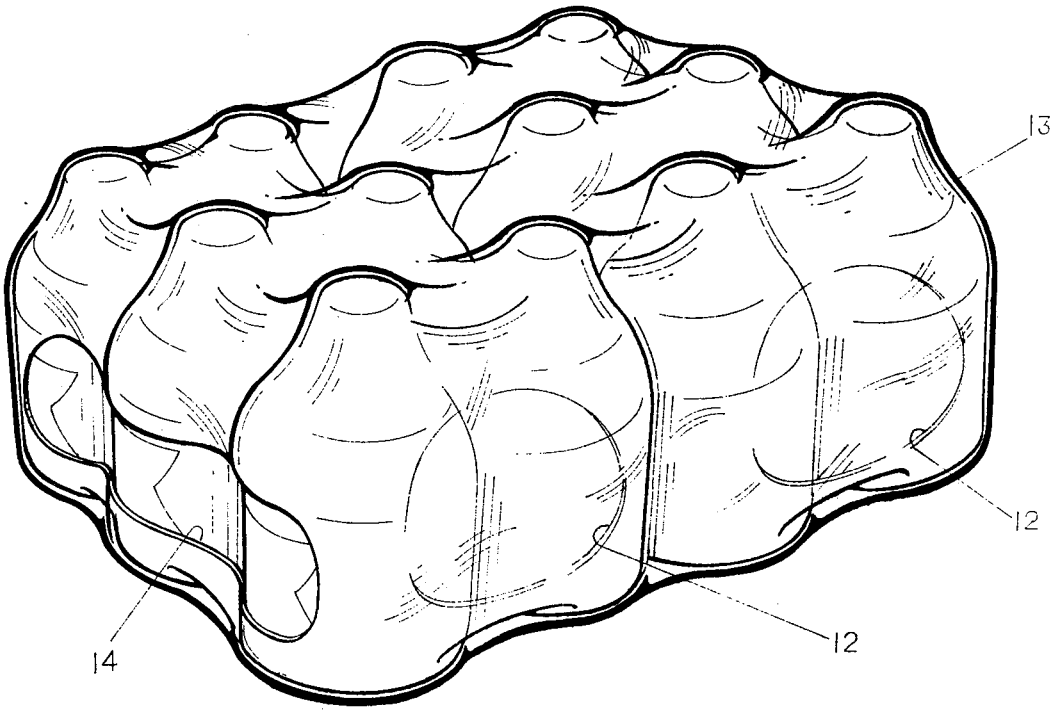
FIG. 2 is a perspective view of two six-bottle shrink packs wrapped in a second layer of generally similar material.

A single shrink wrap package 10 of six filled bottles is shown in FIG. 1, the wrap being formed from a tubular sleeve 11 and having end openings 12. Two six-bottle packages are then heat shrunk in a second layer 13 of heat-shrinkable film in the form of a tubular sleeve having opposed end openings 14 to form a single 12-bottle package. The openings 14 are formed at the covered sides of the six packs so that the double wrapped package is fully enclosed. FIG. 3 shows the coating 15 of release material between wrap layers 11 and 13.

The coated thermoplastic substrate is resistant to the heat shrinking process in that it prevents thermal fusion of the several layers of contacting thermoplastic materials.

Various modifications may be resorted to within the spirit and scope of the appended claims.

I claim:

1. The method of making a double-wrapped pack comprising the steps of shrink-wrapping a plurality of similarly-shaped articles in a first heat-shrinkable ethylene polymer film to form a first package, assemblying a plurality of said packages to form an aligned group, and shrink-wrapping said aligned group within a second heat-shrinkable ethylene polymer film to form a second package, the contacting interface of one of said films being coated with a thin, substantially-continuous release coating of solvent-based polyamide to facilitate ready separation of said films upon opening of said second package.

2. The method in accordance with claim 1, wherein at least one ethylene polymer film is a polyethylene film.

3. The method in accordance with claim 1, wherein both said first and second ethylene polymer films are similar polyethylene films.

4. The method in accordance with claim 1, wherein both said first and second polymer films are similar polyethylene films comprised of a closed cellular foamed layer laminated to a noncellular film layer.

5. The method in accordance with claim 1, wherein said first heat-shrinkable ethylene polymer film is decorated and has an essentially continuous coating of solvent-based polyamide over its exterior surfaces, and said second heat-shrinkable ethylene polymer film is devoid of such coating at least on its interior surface.

6. The method in accordance with claim 1, wherein at least one ethylene polymer film is comprised of a laminated sheet of film and foamed polyethylene having a thickness ranging from about 3 to 20 mils.

7. The method in accordance with claim 1, wherein both said first and second ethylene polymer films are comprised of similar laminated sheets of film and foamed polyethylene, each sheet having a thickness ranging from about 5 to 15 mils.

8. The method in accordance with claim 6, wherein said laminated sheet of film and foamed polyethylene comprises a noncellular film layer laminated to a closed cellular foamed layer.

9. The method in accordance with claim 1, wherein said coating of solvent-based polyamide has a thickness of less than about 1 mil.

10. A double-wrapped pack comprising an assembled group of first packages each comprising a plurality of similarly-shaped articles in aligned relation wrapped in a first heat-shrinkable ethylene polymer film, said assembled group of said first packages in aligned relation being shrink-wrapped in a second heat-shrinkable ethylene polymer film, the contacting interface of one of said films being coated with a thin, substantially-continuous release coating of solvent-based polyamide to facilitate ready separation of said films upon opening of said second package.

11. A double-wrapped pack in accordance with claim 10, wherein both said first and second ethylene polymer films are similar polyethylene films.

12. A double-wrapped pack in accordance with claim 10, wherein said first heat-shrinkable ethylene polymer film is decorated and has an essentially continuous imperforate coating of solvent-based polyamide over its exterior surfaces.

13. A double-wrapped pack in accordance with claim 10, wherein both said first and second ethylene polymer films are similar polyethylene films comprised of a closed cellular foamed layer laminated to a noncellular film layer.

* * * * *